US006426702B1

(12) United States Patent
Young et al.

(10) Patent No.: US 6,426,702 B1
(45) Date of Patent: Jul. 30, 2002

(54) DRIVER FATIGUE DETECTOR

(76) Inventors: Thomas W. Young, 729 Brown Church Rd., Jackson, TN (US) 38302; Frazier R. Thompson, 1895 Steeplebrook Cove, Cordova, TN (US) 38018-5069

( * ) Notice: Subject to any disclaimer, the term of this patent is extended or adjusted under 35 U.S.C. 154(b) by 0 days.

(21) Appl. No.: 09/778,751

(22) Filed: Feb. 8, 2001

(51) Int. Cl.[7] ..... G08B 23/00

(52) U.S. Cl. ..... 340/576; 340/457; 340/575; 340/309.15; 368/109; 368/250; 368/263

(58) Field of Search ..... 340/573.1, 575, 340/576, 457, 309.15; 368/109, 250, 263

(56) References Cited

U.S. PATENT DOCUMENTS 5,012,226 A * 4/1991 Love ..... 340/576
5,402,108 A 3/1995 Tabin et al.
5,559,495 A * 9/1996 Cochran ..... 340/457
5,684,455 A * 11/1997 Williams et al. ..... 340/457
5,684,462 A * 11/1997 Gold ..... 340/576
5,714,925 A * 2/1998 Lee et al. ..... 340/309.15
5,952,928 A * 9/1999 Washington et al. ..... 340/575

* cited by examiner

*Primary Examiner*—Daniel J. Wu
(74) *Attorney, Agent, or Firm*—Larson & Taylor, PLC

(57) ABSTRACT

A device is provided for alerting a driver of an automotive vehicle as to the onset of fatigue, characterized by eyelid droop, head droop and a like condition wherein the eyes of the driver are not directed straight ahead onto the road. The device includes a unit adapted to be affixed to the sun visor of the automotive vehicle so as to be located at the upper periphery of the field of vision of the driver. The unit includes a light element, preferably a red light emitting diode (LED), viewable by the driver in the periphery of the field of vision of the driver. A control circuit controls the LED so as to provide illumination thereof after a predetermined time interval. A driver controlled pushbutton controller connected to the control circuit provides initial energization of the LED while a reset pushbutton provides resetting of the time interval upon depression thereof by the driver. An alarm sounds when the LED has been illuminated after the passage of the predetermined time interval and the push button controller has not been depressed after passage of a further predetermined time period.

20 Claims, 4 Drawing Sheets

DRIVER FATIGUE DETECTOR

FIELD OF THE INVENTION

The present invention generally relates to devices for warning a driver of a vehicle of potentially dangerous situations involving the ability of the driver to operate the vehicle and, more particularly, to an improved device for detecting symptoms of, and warning the driver of, the onset of fatigue or drowsiness.

BACKGROUND OF THE INVENTION

Accidents commonly happen as the result of driver inattention resulting from fatigue or drowsiness. A majority of automobile accidents caused by such fatigue or drowsiness are automobile (motor vehicle) collisions on interstate or other highways where, for example, monotonous road and scenery conditions promote "highway hypnotism" and attendant driver fatigue and/or drowsiness.

Devices have been developed which sound an alarm to alert the driver when the driver has dozed off but which do not test the current driving ability of the driver and thus are of limited value in many potentially dangerous situations. Other devices do test the driver but suffer other shortcomings. The latter category includes devices such as those described in U.S. Pat. Nos. 5,684,455 to Williams et al and 5,402,108 to Tabin et al. The Williams et al patent discloses a driver alerting device comprising green, yellow and red indicator lights, a timer, a resetting mechanism and an audible alarm. The driver is required to reset the device after the illumination of the green light. If the device is not reset before a first timed period has elapsed, the yellow light then illuminates and flashes for a second timed period. If the device is not reset before the second timed period has elapsed, the red light then illuminates and flashes, and the audible alarm sounds until the device is reset. The Tabin et al patent discloses a driver alerting device including a red indicator light, a timer, a resetting mechanism and an audible alarm. The driver is required to reset the device within a timed period after the red indicator light illuminates and begins flashing. If the driver does not reset the device before the timed period has elapsed, the audible alarm then sounds.

SUMMARY OF THE INVENTION

In accordance with the invention, a driver fatigue detector is provided which tests a driver for the onset of fatigue and/or drowsiness and, more particularly, in accordance with an important aspect of the invention, tests the driver as to whether the eyes of the driver are properly focussed on the road ahead. The device of the invention interrupts periods of fatigue or drowsiness by causing the driver to respond or be warned. The invention will reduce or eliminate accidents attributable to the phenomenon of "highway hypnotism" described above, will reduce such accidents such as rear-end collisions and potentially dangerous situations occurring in the traffic lane and on the side of the road, running off the road, crossing the center line or median, sideswiping moving or parked vehicles, running red lights or stop signs, loss of control or rollovers due to evasive maneuvers, and rollovers or like accidents at exit ramps caused by fast last minute turns caused by the inattention of the driver in noting a desired exit in time to slow down. As discussed in more detail below, the ability of the device of the invention to test whether the eyes of the driver are properly directed to the road ahead is a major advantage over prior art devices of the same general type.

According to the invention, a device is provided for alerting a driver of an automotive vehicle as to the onset of fatigue, characterized by eyelid droop, head droop and a like condition wherein the eyes of a driver are not directed straight ahead onto the road, the device comprising: a housing or case adapted to be affixed to a portion of the automotive vehicle so as to be located at the upper periphery of the field of vision of the driver, the housing comprising: an indicator lamp viewable by the driver in the upper periphery of the field of vision of the driver, an electrical control circuit for controlling illumination of said indicator lamp so as to provide illumination thereof after passage of a predetermined time interval, a driver controlled reset switch for providing resetting of said time interval upon depression of the reset switch by the driver, and alarm means for producing an alarm signal when the indicator lamp has been illuminated after the passage of said predetermined time interval and one reset switch has not been depressed after passage of a further predetermined time period.

Preferably, the housing further comprises a driver controlled pushbutton controller connected to the control circuit for providing initial energization of said indicator lamp.

Advantageously, the housing includes affixing means for affixing the housing to a sun visor of the vehicle. The affixing means preferably comprises a spring clip secured to the housing and adapted to clip onto the sun visor.

In a beneficial implementation, the housing further comprises a mounting member extending outwardly from the housing for mounting the indicator lamp so as to face the driver when the housing is affixed to the sun visor or otherwise disposed in an upper peripheral portion of the field of view of the driver. The indicator lamp preferably comprises a light emitting diode. Advantageously, the indicator lamp comprises a red light element.

The housing preferably further comprises an interior compartment including, housed therein, a circuit board containing the control circuit.

The electrical control circuit preferably includes a counter circuit for counting the number of times that the indicator lamp has been illuminated.

Advantageously, the housing further comprises a master reset switch for resetting the predetermined time interval to a different, longer duration interval.

In a beneficial embodiment, the housing includes a battery storage area for storing batteries for supplying power to said control circuit. Alternatively, or in addition, the housing preferably includes a connector for connecting the control circuit to an external electrical power source such as the cigarette lighter of the vehicle.

The alarm means preferably includes an alarm and an alarm control, forming a part of said electrical control circuit, for controlling actuation of the alarm such that the alarm is activated if the reset switch is not actuated after said indicator lamp has been illuminated. Advantageously, the electrical control circuit includes means for monitoring said alarm control circuit and for turning said electrical control circuit off if said alarm control circuit is not reset after the passage of a further predetermined time interval (e.g., a few minutes) in order to save power.

Further features and advantages of the present invention will be set forth in, or apparent from, the detailed description of preferred embodiments thereof which follows.

DESCRIPTION OF THE PREFERRED EMBODIMENTS

Figure 1:
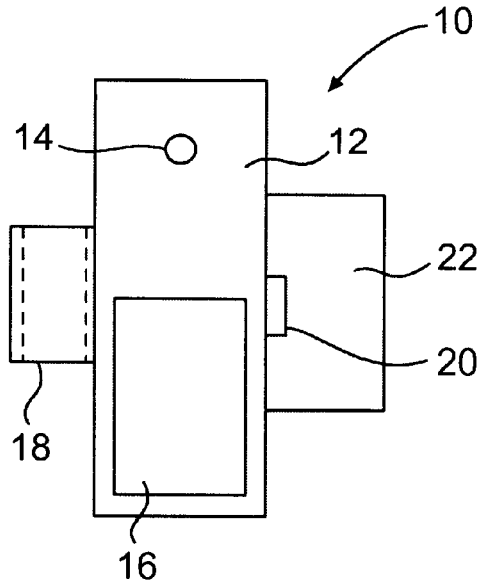
FIG. 1 is an end elevation view of a driver fatigue device constructed in accordance with a preferred embodiment of the invention.
Figure 2:
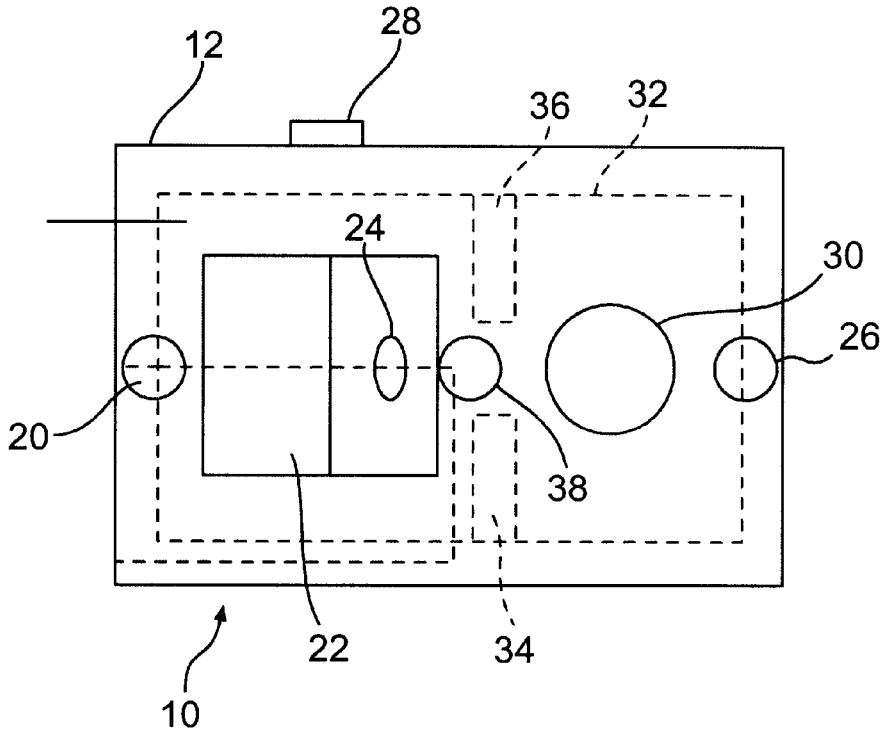
FIG. 2 is a top plan view of the device of FIG. 1.
Figure 3:
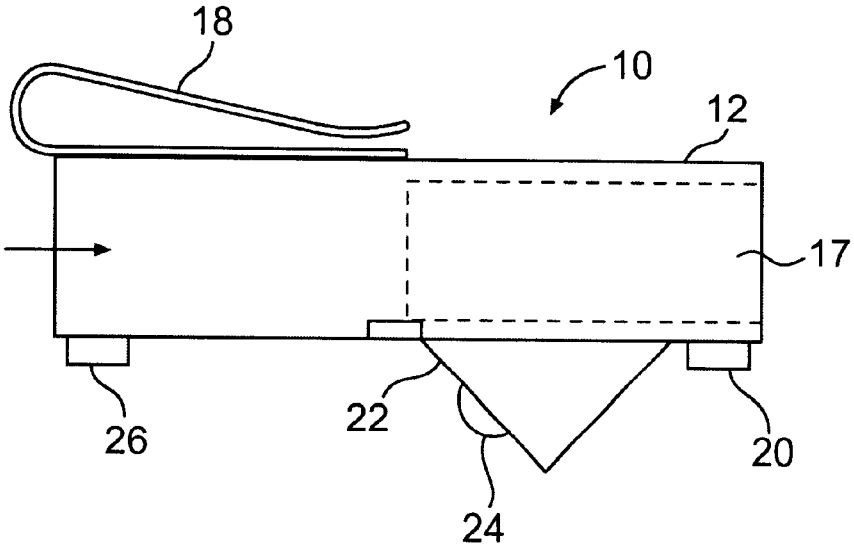
FIG. 3 is a side elevational view of the device of FIG. 1.

Referring to FIGS. 1 to 3, there is shown a preferred embodiment of the driver fatigue detector device of the invention. The device, which is generally denoted 10, includes a housing or case 12 which is preferably made of a plastic or metal and which houses the control circuitry for the device. This control circuitry is discussed below in connection with FIG. 6.

As shown in FIG. 1, the housing 12 includes, at one end thereof, an electrical connector or jack 14 and a cover 16 for a battery storage area or compartment 17 (see FIG. 3) located within housing 12.

Figure 4:
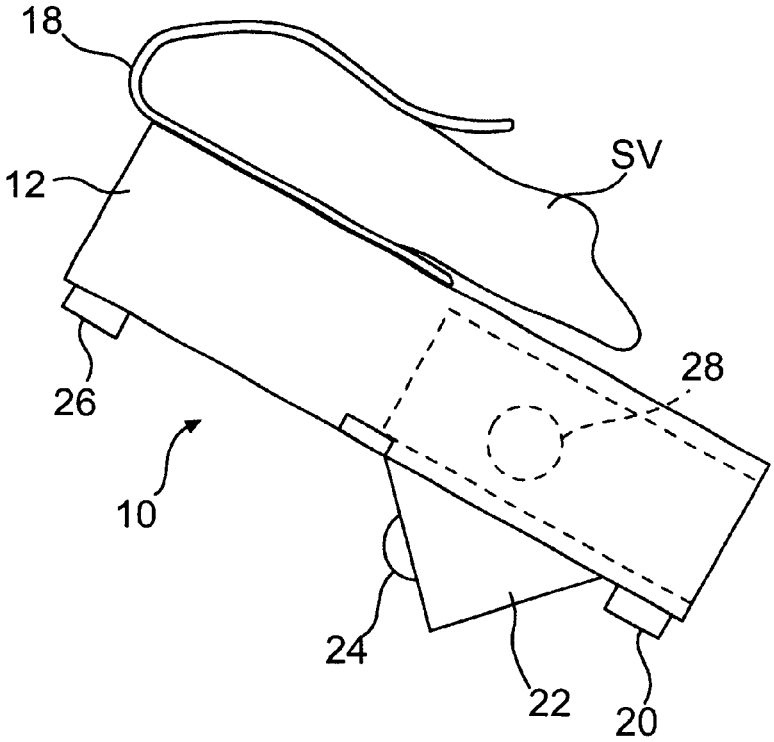
FIG. 4 is a side elevational view similar to that of FIG. 3, showing the device as preferably positioned in use.

A generally U-shaped clip 18, best seen in FIGS. 3 and 4 is preferably used to affix the device 10 to a sun visor, indicated generally at SV in FIG. 4, although other means such as a hooks and loops fastener (e.g., a VELCRO ® fastener) can also be used for this purpose.

Also shown in FIG. 1, as well as in FIGS. 2 to 4, is a power "on" push button 20 used to provide starting and stopping, i.e., switching on and off, of the electrical supply for the electronic control circuitry or system as described below, and a light mounting member 22 which, as shown in FIG. 3, is of a triangular shape in side elevational profile. As shown in FIGS. 2 to 4, member 22 serves to mount, and serves as a backdrop for, an indicator lamp or light 24 which preferably comprises a red light emitting diode. Indicator light 24 initially provides a "power on" indicator and later serves as a test light used to test whether the upper field of vision of the driver has remained within an area including light 24 as would be the case where the eyes of the driver are properly focussed on the road ahead.

As shown in FIGS. 2 to 4, at the other end of housing 12 from push button 20 is a reset push button 26 used for resetting as various units of the electronic control system as described below. A master reset push button 28 is provided on one side of case 12 and, as described below, is used to reset the test cycle, e.g., from five minutes to fifteen minutes.

Also shown in FIG. 2 is an alarm 30 which sounds to notify the driver that the indicator lamp 24 has not been seen (based on the fact that the device has not been reset) and thus warns the driver for whatever reason, that he or she is not seeing the upper edge of his or her normal field of vision.

Further illustrated in FIG. 2 is a circuit board 32 on which are located all of the control circuits to be described. These include an alarm counter circuit 34 which counts and displays the number of times that the alarm 30 has been activated since the last time that the device was reset and a light "on" counter circuit 36 which counts and displays the number of times that the indicator light 24 has been activated since the last time that the device was reset. In addition, a device or meter reset button 38 is provided which is used to reset counter units 34 and 36.

Figure 5:
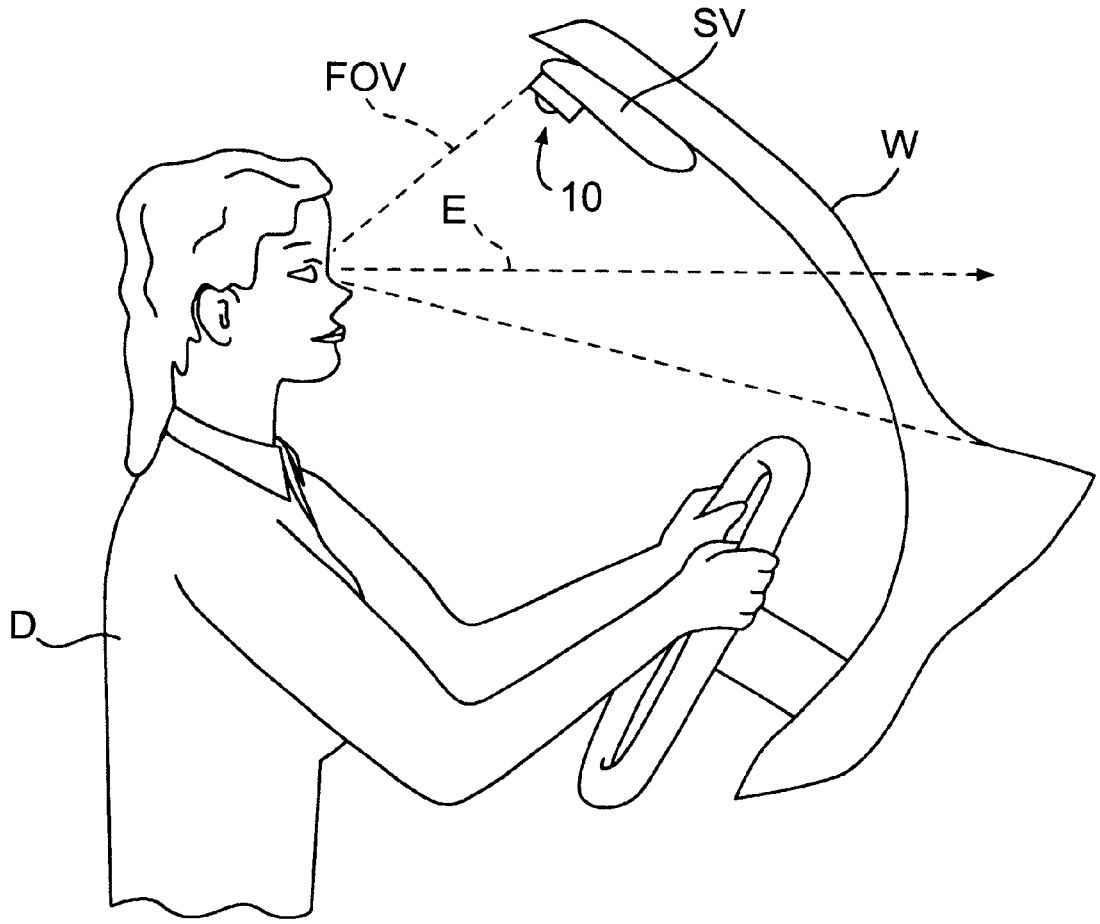
FIG. 5 is a partially broken away, schematic representation of a driver in an automobile showing the device of the invention in use.

Referring to FIG. 4, the device 10 is shown mounted on sun visor SV, as indicated above. As shown, support member or projection 22 enables indicator light (LED) 24 to be positioned so as to face the driver and to be located in the driver's upper peripheral field of view. This is also illustrated in FIG. 5, wherein a driver D is shown in proper driving position, eyes on the road ahead, as indicated by the headed dashed line E, through the windshield W and with the device 10 disposed at the upper margins of field of view FOV of the driver.

Figure 6:
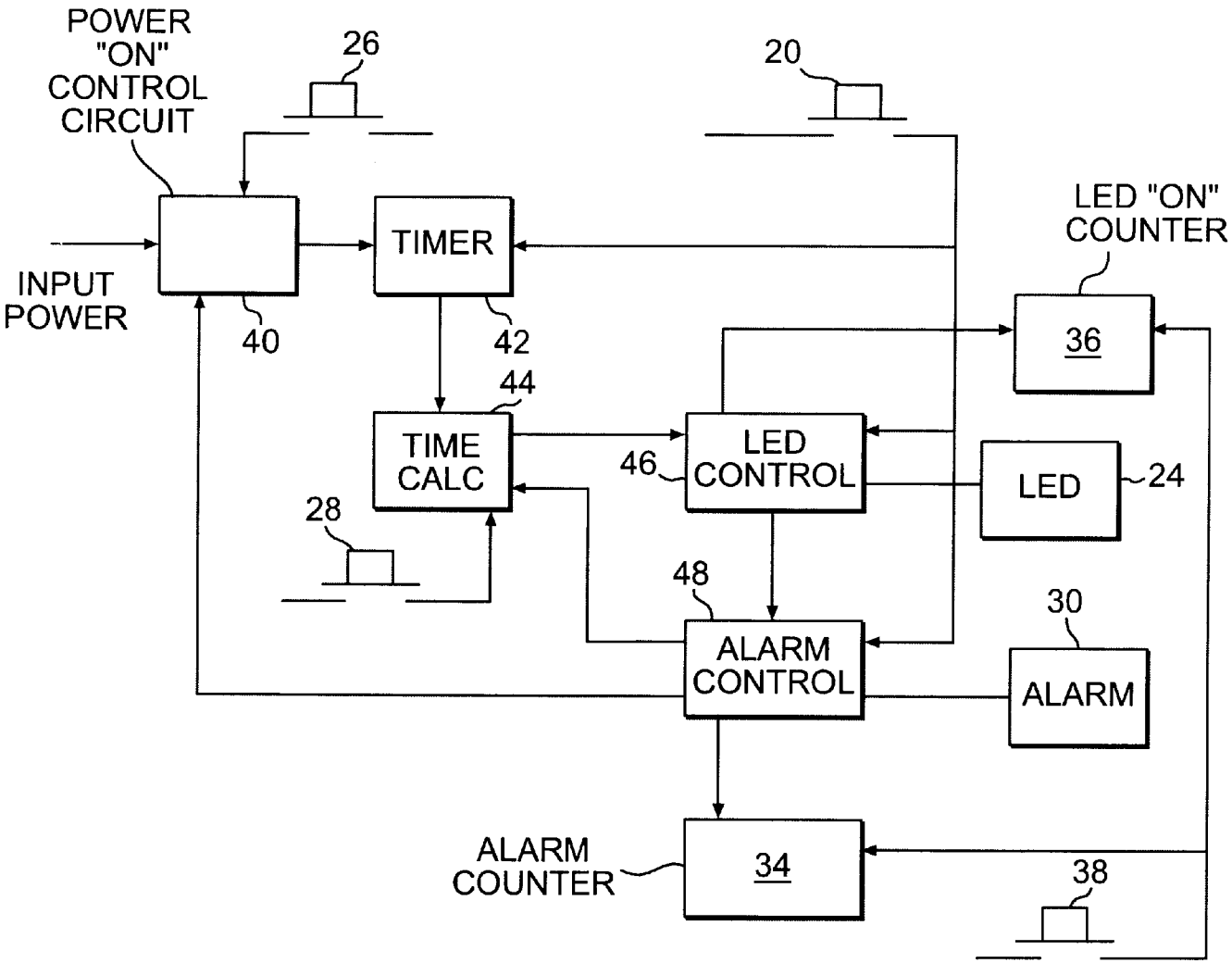
FIG. 6 is a block diagram of a preferred embodiment of the electrical system of the device of the invention.

Referring to FIG. 6, a block form schematic circuit diagram of the electronic indicator and control system is shown. A "power on" control circuit 40 receives input power from batteries in battery compartment 17 or from another source such as the cigarette lighter (not shown) of the vehicle and provides initial power for the system when the "power on" push button 26 connected thereto is depressed. This results in illumination of indicator light or lamp (LED) 24 for a predetermined short time period, preferably 5–12 seconds, to verify the "power on" condition of the system.

As illustrated, LED 24 is connected to control circuit 40 through a timer or timing circuit 42, a time calculator circuit 44 and an LED control or firing control circuit 46. Activation of the time calculator circuit 44 is controlled by the push button switch 28 described above and by an alarm control or firing control circuit 48. The timer or timing circuit 42 provides pulses to produce cycling of the time calculator circuit 44 and can be reset by push button reset switch 20. The time calculator circuit 44 calculates cycle minutes and resets seconds.

The LED control circuit 46 is connected to the LED "ON" counter 36 and to alarm control circuit 48 and both are connected to the push button control (reset) switch 20. The LED control circuit 46 activates LED 24 based on input signals from the time calculation circuit. The alarm control or firing control 48 activates alarm 30 if activation (lighting) of the LED 24 is not acknowledged when activated and the reset push button 20 has not been depressed. If the alarm control circuit 48 is active for more than a predetermined time period (advantageously, one minute), the overall control system is completely turned off in order to save battery power when the vehicle is left unattended.

Summarizing the operation of device 10 and revisiting some of the features discussed above, the device of the invention is to be positioned on the sun visor SV or at another equivalent location at the extreme upper edge of the window of vision or field of view of the upper edge of a properly positioned driver. The small red LED 24 is mounted on a surface of support member 22 facing the driver that the LED 24 illuminates when power switch 26 is activated to indicate "power on." Immediately after power activation, the reset switch 20, which is preferably a protruding red push button, must be pressed so that the illuminated red LED 24 is turned off and, at the same time, acts thereafter as the driver testing light for the device 10. In this regard, the red LED 24 is controlled by the built-in timer circuit 42 and after being initially turned off at the beginning of the sequence, is automatically illuminated every 15 minutes. The driver will acknowledge this by pressing the protruding red push button 20 within a short period (e.g., 7 seconds) after illumination. If the red push button 20 is not pressed, the alarm 30 will sound until the red push button 20 is pressed. Once the alarm 30 sounds, the timed cycle will be automatically reduced to a predetermined period, e.g., 5 minutes because the control circuit detects that the driver missed the illuminating of the red LED 24. As noted above, LED 24 is positioned at the top of the driver's window of vision or field of view and illumination thereof will typically be missed because the head of the driver was tilted down or the eyelids slightly closed as a result of fatigue or drowsiness. The device of the invention detects such a condition and, if necessary, alerts the driver.

In one advantageous embodiment, the system provides for automatically resetting of the timer to a shorter cycle period once the alarm 30 has been activated so as to make certain that the driver is fully awake. Preferably, the system would remain at this shorter cycle period through several cycles before returning to the original cycle period or would progressively cycle back to the original cycle period using progressively increasing cycle periods.

In a preferred embodiment, the driver has the option to reset the timer 42 to the 15 minute cycle by activating master reset switch 28, which is typically a protruding black push button.

Advantageously, the driver also has the option to turn the detector unit 10 off when, for example, in heavy city traffic or at any time that the driver can be certain that fatigue or drowsiness will not set in. Wisely selected use of the device 10 can be an asset to the driver and prevents the device from becoming a nuisance when obviously not required. This makes the device more "user friendly" which, in return, will promote the use of the device when needed.

In an advanced commercial embodiment of the invention (not shown), a dual counter is provided with a single reset. One counter is used to record the number of illuminations of LED 24, thereby verifying the number of times that power was supplied to the unit 10, i.e., that the unit was activated. The other counter counts the number of times that the alarm 30 sounded, if any. This commercial embodiment could be dispensed by a dispatcher and upon being returned to the manager or dispatcher, the issue of safety can be addressed by observing the number of alarms that were sounded over a given period of time.

It will be evident from the foregoing that the device of the present invention will maintain the window of vision of a driver on the road ahead and alert an inattentive driver and then warn the driver of the potential onset of fatigue and/or drowsiness. The present invention performs well in the daytime and especially well after dark because the size and location of the small red LED 24 will restrict the amount of light emitted and the ability thereof to undesirably brighten up the interior of a vehicle and cause the driver to not notice the LED 24. A driver with a tilting head or closing eyelids should not see a flash of light from the LED 24 and thus the limit would not get his or her attention and acknowledgement. Without this acknowledgement in the form of depressing switch 20, the alarm 30 will sound. Thus, the device keeps the driver alert and his or her window of vision on the road ahead, and the driver must have eye contact with the small red LED 30 and act in response thereto or else the driver will be warned by the alarm. The size and location of the warning light (LED) 34 sharply contrasts with prior art systems such as those of the Tabin and Russell patents which employ relatively large lights deployed so even a fatigued or drowsy driver will be aware of the lights, especially at night and will thus be able to perform the "testing" required even though the driver is driving impaired.

Although the invention has been described above in relation to preferred embodiments thereof, it will be understood by those skilled in the art that variations and modifications can be effected in these preferred embodiments without departing from the scope and spirit of the invention.

What is claimed is:

1. A device for alerting a driver of an automotive vehicle as to the onset of fatigue, characterized by eyelid droop, head droop and a like condition wherein the eyes of a driver are not directed straight ahead onto the road, said device comprising:

a housing adapted to be affixed to a portion of the automotive vehicle so as to be located at the upper periphery of the field of vision of the driver, said housing comprising:

an indicator lamp viewable by the driver in the upper periphery of the field of vision of the driver, an electrical control circuit for controlling illumination of said indicator lamp so as to provide illumination thereof after passage of a predetermined time interval, a driver controlled reset switch for providing resetting of said time interval upon depression thereof by the driver; and alarm means for producing an alarm signal when said indicator lamp has been illuminated after the passage of said predetermined time interval and said reset switch has not been depressed after passage of a further predetermined time period;

said electrical control circuit including counter means for counting and recording the number of times that said indicator lamp is illuminated.

2. A device as claimed in claim 1 wherein said housing further comprises a driver controlled pushbutton controller connected to said control circuit for providing initial energization of said indicator lamp.

3. A device as claimed in claim 1 wherein said housing includes affixing means for affixing the housing to a sun visor of the vehicle.

4. A device as claimed in claim 3 wherein said affixing means comprises a spring clip secured to said housing.

5. A device as claimed in claim 4 wherein said housing further comprises a mounting member extending outwardly from said housing for mounting said indicator lamp so as to face the driver when said housing is affixed to the sun visor.

6. A device as claimed in claim 5 wherein said indicator lamp comprises a light emitting diode.

7. A device as claimed in claim 5 wherein said indicator lamp comprises a red light element.

8. A device as claimed in claim 1 wherein said housing further comprises an interior compartment including, housed therein, a circuit board containing said electrical control circuit.

9. A device as claimed in claim 1 wherein said housing further comprises a master reset switch for resetting the time interval to a different, longer duration interval.

10. A device as claimed in claim 1 wherein said housing includes a battery storage area for storing batteries for supplying power to said electrical control circuit.

11. A device as claimed in claim 1 wherein said housing includes a connector for connecting the electrical control circuit to an external electrical power source.

12. A device as claimed in claim 1 wherein alarm means includes an alarm and an alarm control circuit, forming part of said electrical control circuit, for controlling actuation of said alarm such that said alarm is activated if the reset switch is not actuated after said indicator lamp has been illuminated.

13. A device as claimed in claim 12 wherein said electrical control circuit includes means for monitoring said alarm control circuit and for turning said electrical control circuit off if said alarm control circuit is not reset after the passage of a further predetermined time interval.

14. A device as claimed in claim 1 wherein said electrical control circuit further comprises means for counting and recording the number of times that said alarm means has been activated.

15. A device as claimed in claim 1 wherein said electrical control circuit includes a timer for controlling said predetermined time interval and means for setting the duration of said predetermined time interval to a shorter cycle period once said alarm means has been activated.

16. A device for alerting a driver of an automotive vehicle as to the onset of fatigue, characterized by eyelid droop, and head droop like condition, wherein the eyes of a driver are not directed straight ahead onto the road, said device comprising:

a housing adapted to be affixed to a portion of the automotive vehicle so as to be located at the upper periphery of the field of vision of the driver, said housing comprising:

an indicator lamp viewable by the driver in the upper periphery of the field of vision of the driver, an electrical control circuit for controlling illumination of said indicator lamp so as to provide illumination thereof after passage of a predetermined time interval, a driver controlled reset switch for providing resetting of said time interval upon depression thereof by the driver; and alarm means for producing an alarm signal when said indicator lamp has been illuminated after the passage of said predetermined time interval and said reset switch has not been depressed after passage of a further predetermined time period;

said electrical control circuit including a timer for controlling said predetermined time interval and means for setting the duration of said predetermined time interval to a shorter cycle period once said alarm means has been activated.

17. A device as claimed in claim 16 herein said duration of said cycle period is set so as to increase incrementally after the initial setting thereof so as to reach an initial cycle period after a preselected time period has passed without activation of said alarm means.

18. A device as claimed in claim 17 wherein said electrical control circuit further comprises means for counting and recording the number of times that said alarm means has been activated.

19. A device for alerting a driver of an automotive vehicle as to the onset of fatigue, characterized by eyelid droop and head droop condition wherein the eyes of a driver are not directed straight ahead onto the road, said device comprising:

a housing adapted to be affixed to a portion of the automotive vehicle so as to be located at the upper periphery of the field of vision of the driver, said housing comprising:

an indicator lamp viewable by the driver in the upper periphery of the field of vision of the driver, an electrical control circuit for controlling illumination of said indicator lamp so as to provide illumination thereof after passage of a predetermined time interval, a driver controlled reset switch for providing resetting of said time interval upon depression thereof by the driver; and alarm means for producing an alarm signal when said indicator lamp has been illuminated after the passage of said predetermined time interval and said reset switch has not been depressed after passage of a further predetermined time period;

said electrical control circuit further comprises means for counting and recording the number of times that said alarm means has been activated.

20. A device as claimed in claim 19 wherein said electrical control circuit including a timer for controlling said predetermined time interval and means for setting the duration of said predetermined time interval to a shorter cycle period once said alarm means has been activated.

* * * * *